US005417428A

United States Patent [19]

Warren

[11] Patent Number: 5,417,428

[45] Date of Patent: May 23, 1995

[54] GOLFER'S AID

[75] Inventor: Preston A. Warren, Waterloo, Canada

[73] Assignee: 953406 Ontario Limited, Waterloo, Canada

[21] Appl. No.: 143,757

[22] Filed: Nov. 1, 1993

[30] Foreign Application Priority Data

Feb. 24, 1993 [CA] Canada ..... 2090258

[51] Int. Cl.[6] ..... A63B 69/36

[52] U.S. Cl. ..... 273/187 A

[58] Field of Search ..... 273/187 A, 187 R, 187 B, 273/187.1

[56] References Cited

U.S. PATENT DOCUMENTS

| | | | |
|---|---|---|---|
| 2,707,638 | 5/1955 | Manley | 273/187 A |
| 3,784,208 | 1/1974 | Weygandt | 273/187 AX |
| 4,415,159 | 11/1983 | Matheny et al. | 273/187 A |
| 4,915,387 | 4/1990 | Baxstrom | 273/187 A |
| 5,255,921 | 10/1993 | Spence | 273/187 A |

*Primary Examiner*—George J. Marlo
*Attorney, Agent, or Firm*—Daryl W. Schnurr;

[57] ABSTRACT

A golf monitoring device and method of use thereof relates to a one-piece elongated layer of rigid but slightly flexible plastic that has fold lines and can be folded into three sections. The device has a front edge and a rear edge with one straight side edge and one curved side edge. The device fits entirely between the golfer and the ball with the golfer's feet adjacent to the straight edge and the ball adjacent to the curved edge. The ball is located on an opposite side of the device from the golfer's feet and neither the ball nor the golfer's feet are supported or located on the device. The curved edge approximates a two-dimensional path of a golf swing. Along the straight edge is a rear foot indicator, which is variable within a defined limit, and a front foot indicator which is fixed. On the curved edge, there is a ball indicator which is variable. The ball indicator is located near to the front of the device and provides for placement of the ball in a location where the ball will form an acute-angled triangle with the foot indicators.

11 Claims, 1 Drawing Sheet

GOLFER'S AID

BACKGROUND OF THE INVENTION

1. Field of the Invention

This invention relates to golf monitoring devices and a method of use thereof and, more specifically, to a golf monitoring device that can be used by a golfer for practice purposes to assist the golfer in achieving an optimum stance relative to a golf ball for a particular club.

2. Description of the Prior Art

Previous devices for training or assisting golfers to improve their stance or swing relative to the ball are known but are either too restrictive; or, they teach a golfer wrongly or improperly; or, they are too cumbersome; or, their use alters the location of the ball and/or the feet of the golfer from the location on the ground that would be used during an actual golf round; or, they are not readily portable; or, they are too expensive; or, they are too complex; or, they necessitate moving the ball to a location on the device; or, they are unsuitable for use during an actual round of golf; or, they are not sufficiently versatile to assist virtually all golfers; or, they do not provide sufficient guidance for location and/or squaring of the feet relative to the device; or, they are in several pieces and take too long to set up or dismantle; or, they can only be used with a tee. One prior patent is entitled, "Device for Developing Golf Ball Address Stance" relating to U.S. Pat. No. 4,805,913 issued Feb. 21st, 1989 and naming Roger Bott as the inventor. The Bott patent discloses a mat with removably attachable or adhesive foot silhouettes on a graphic surface thereof. A user stands on the foot silhouettes and strikes a ball which is also located on the mat. The Bott device does not provide true golfing conditions as both the feet of the user and the ball are located on the mat rather than on the ground itself. Also, the mat is too cumbersome and is not readily portable. In addition, the location of both of the user's feet are variable. Also, the location of the feet are variable over too wide of a range which is not sufficiently narrow to easily assist the user. Another practice device for golfers is described in U.S. Pat. No. 3,550,946 issued to Menendez, et al. The Menendez device is used with the ball mounted on a tee on the device and does not provide sufficient guidance for the location of the feet. Also, it has several pieces and requires assembly and dismantling. Further, it does not fit entirely between the golfer and the ball.

SUMMARY OF THE INVENTION

It is an object of the present invention to provide a golf swing monitoring device that is simple, but effective. It is a further object to provide a golf swing monitoring device that provides sufficient guidance to assist a user but is yet flexible enough so that it can assist virtually all users regardless of their type of swing. It is still a further object of the invention to provide a device that is inexpensive, light-weight and compact enough to fit easily within a golf bag and that, when used, does not alter the location of the ball and/or the feet of the golfer from the location on the ground (or on a tee) that would be used during an actual golf round. In this specification (including the claims), when an expression is used in relation to the device of the present invention that a golf ball rests on the ground, that expression and similar variations thereof shall be deemed to include a golf ball that is located on a tee stuck into the ground in the normal manner that is used by golfers during a round of golf.

A golf swing monitoring device is used with a golf club and a golf ball by a user having two feet. The device has an elongated layer having a front edge, a rear edge and two side edges, a first side edge and a second side edge. The device is small enough so that it can be located entirely between the user and the ball with the device being oriented between the user and the ball with the first side edge being adjacent to the user and the second side edge being adjacent to the ball. Both the ball and the user are located beyond the device. The first edge has a first rear foot indicator and a second front foot indicator thereon, said foot indicators being spaced apart from one another. The first indicator represents a placement of the rear foot of the user, said first indicator being variable. The second foot indicator represents a placement of the front foot of the user, with a third indicator for placement of said ball at a point beyond said second side edge so that said ball forms an imaginary acute-angled triangle with said foot indicators, said third indicator being variable.

A method of monitoring a golf swing for at least one golf club uses a device that is small enough to fit entirely between a location of the golf ball and a user's two feet. The device has front and rear edges with a first side edge and a second side edge, the first edge having two foot indicators, one indicator for the front foot being fixed and another indicator for the rear foot being variable. A ball location indicator that is also variable is located on said second side edge. The method comprises the steps of placing the device on the ground with the front edge extending in a direction that the user wishes to propel the golf ball, the feet of the user being located adjacent to the first side edge, placing the front foot on the ground adjacent to the device in alignment with the first indicator, placing the rear foot on the ground adjacent to the device and aligning the rear foot within a range of variation of the second indicator, placing the ball on the ground beyond second side edge, swinging the ball at the club and noting the type of trajectory for the ball, repeating the steps of locating the feet and ball for several different locations of the rear foot and the ball and taking a swing at each location using the same golf club and noting the trajectory of the ball for each swing as well as the location of the ball and rear foot relative to the device until finding a location of the rear foot and ball that produces a satisfactory trajectory for the ball for that particular club and repeating the steps for a different golf club.

DESCRIPTION OF A PREFERRED EMBODIMENT

Figure 1:
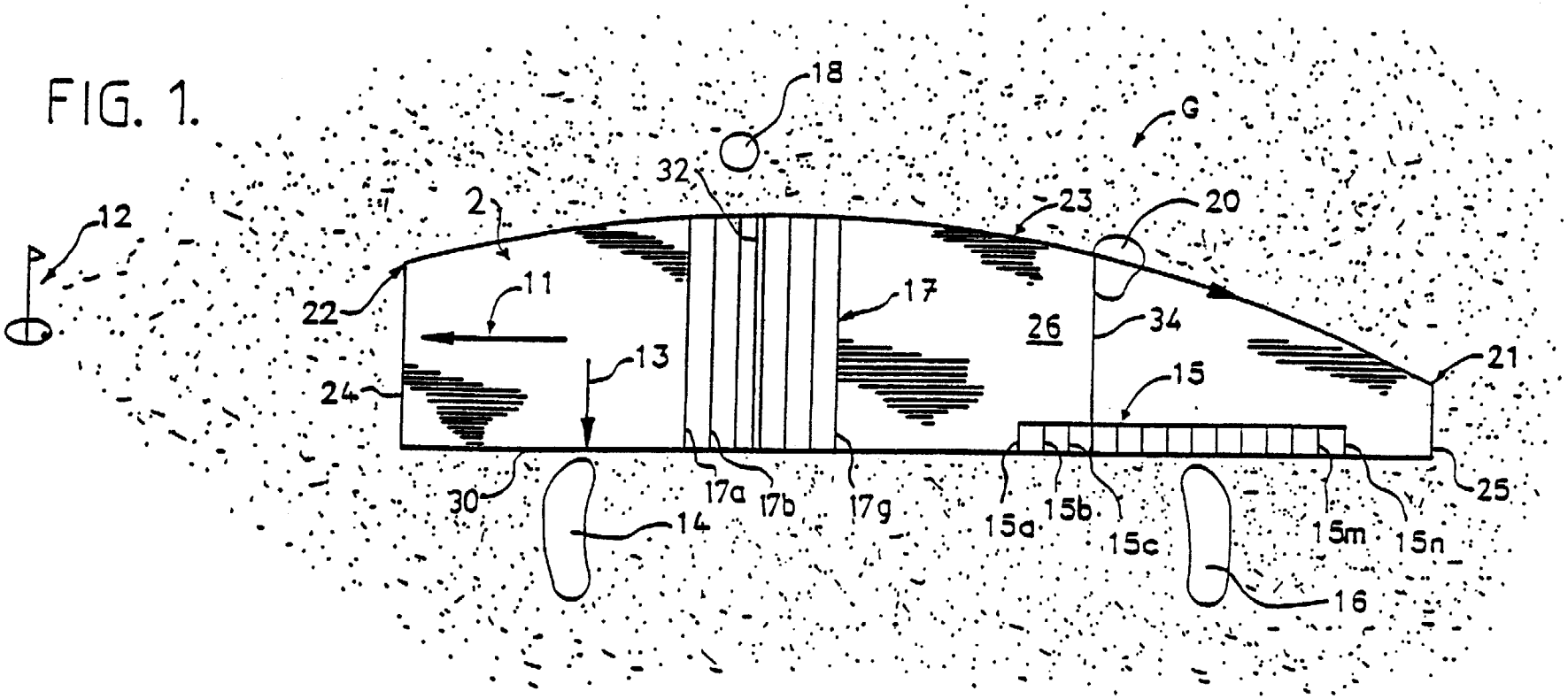
FIG. 1 is a top view of the layer on the ground.

In the drawings, it can be seen that a golf swing monitoring device 2 has a layer 10 with an upper surface 26 and a lower surface 28. The layer 10 has a front edge 24, a rear edge 25, a first side edge 30 and a second side edge 23. The first side edge 30 is a straight edge and the second side edge 23 is a curved edge that approximates a two-dimensional golf swing of the user from point 21 to point 22. The device is oriented between a user (not shown) having feet 14, 16 and ball 18 with the first side edge 30 being adjacent to the user (i.e. the user's feet)

and the second side edge being adjacent to the ball 18. Both the ball 18 and the user (i.e. the user's feet) are located beyond the device. The first side edge 30 has a first rear foot indicator 15 and a second front foot indicator 13 thereon. The foot indicators 13, 15 are spaced apart from one another and the first indicator 15 represents a placement of the rear foot 16 of the user, said first indicator 15 being variable over a range of positions 15*a* . . . 15*n*. The second foot indicator 13 represents a placement of the front foot 14 of the user with a third indicator 17 for placement of the ball 18 at a point beyond said second side edge 23 so that the ball 18 forms an imaginary acute-angled triangle with said foot indicators 13, 15. The third indicator is variable through positions 17*a* . . . 17*g*. The location of the second foot indicator 13 is fixed.

The positions 15*a* . . .15*n* are a first set of location indicia representing the first foot indicator 15 and the positions 17*a* . . . 17*g* are a second set of location indicia representing the third indicator 17. Preferably, the indicia 17*a* . . . 17*g* extend completely across the device from the curved edge 23 to the straight edge 30 to assist the user in noting the location of the ball 18 relative to his feet 14, 16. The upper surface 26 is designed to be used for right-handed golfers and the lower surface 28 is designed to be used by left-handed golfers. The device is only described and shown for the upper surface 26 but the use of the device and the first, second and third indicators on the upper surface 26 are a mirror image of the first, second and third indicators (not shown) on the lower surface 28 so that a left-handed user can make use of the device simply by flipping it over so that the lower surface 28 is up and the upper surface 26 is down.

Figure 2:
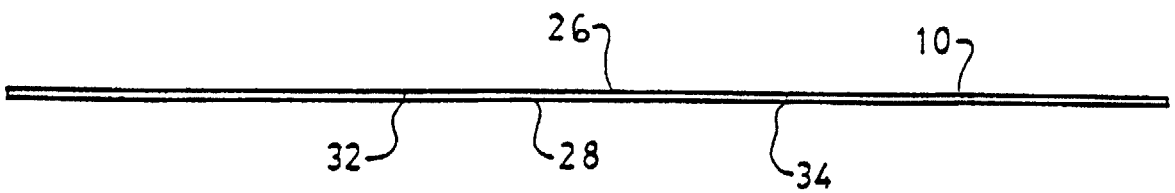
FIG. 2 is a side view of the layer without the ground.

The device 2 is one-piece and the layer 10 is foldable into three sections along fold lines 32, 34. The device has a target indicator 11 being parallel to the first side edge 30 located on each of the upper and lower surfaces 26, 28 (not shown on the lower surface 28). The target indicator 11 points in a direction that the ball is to be propelled (in FIG. 2, towards a pin 12). The device 2 can be made of any convenient size as long as it is small enough to be readily portable and to fit entirely between the user and the golf ball when the user is in a position to swing at the ball. Preferably, the device has an overall length of substantially 82 cm and a maximum width (i.e. at its widest part) of substantially 14.3 cm. When the device is folded into three sections, the folded device preferably has a size of substantially 27.5 cm×15.5 cm×1 cm.

It can be seen that the third indicator 17 is in an area near the second foot indicator 13 but on said second side edge 23 the third indicator is preferably variable within a lateral range of approximately 11 cm while the first indicator is variable within a lateral limit of approximately 17 cm.

During use of the device, it is preferable that the user's feet be placed on the ground approximately 7" from the straight edge and that the ball be placed on the ground approximately 3" beyond the curved edge 23. Since the foot indicators 13, 15 are located on the straight edge 30, it is relatively easy for the user to square both feet relative to the straight edge and thereby square his shoulders (not shown) relative to said straight edge.

When using the device, the placing of the device on the ground, the placing of the feet and placing of the ball can be performed in random order. The device can be used to monitor the user's swing with various golf clubs 20. The ball can be placed on the ground or it can be placed in a tee located on the ground. The device can even be used for each shot or intermittently during an actual round of golf. For example, the user could start using the device at the tee shot in the round of golf. For the second shot, the ball could be lying on the fairway and the user could approach the ball and orient the device relative to the ball so that the ball was in the appropriate range of the third indicator 17 beyond the curved edge 23. The target indicator 11 would be directed towards the location to which the ball is desired to be propelled. The user could then locate both of his feet appropriately and swing at the ball. The ball would be propelled to another location and the procedure could be repeated at that location. Preferably, the device would not be used in an actual round of golf until after the user had practiced sufficiently with the device with each type of club and various locations of the ball and rear foot so that the user knew the approximate optimum location of the ball and rear foot for each club. Then, during an actual round of golf, if the user wished to refresh his memory of the optimum location, he could use the device to do so. Of course, use of the device during an actual round of golf would be contrary to the official rules of golf. Also, a user could use the device to teach himself to address the ball properly with each type of club and then play several rounds of golf without the device. However, if the user's level of play began to deteriorate, the user might again refresh his memory by taking some swings with various clubs using the device.

The device of the present invention is versatile as it allows each individual user to discover through practice or experimentation, the particular location of the ball relative to the feet of the user that is the optimum location for each golf club of the user. The optimum location will vary from golfer to golfer and, sometimes, the optimum golf swing for a particular golfer will be unique to that golfer and will not be suitable or productive for other golfers.

The device of the present invention provides guidance to the user for properly addressing the ball but does not restrict the user in any way. The range of location for the rear foot is limited as is that range of location for the ball so that a user will be sufficiently directed to the proper stance for addressing the ball quickly and efficiently.

The curved side 23 provides a swing-path guideline that provides a guideline both for the take-away path of a golf club head 20 (shown in shadow) as it is moved rearward and a forward follow-through path for the head near the front edge 24. The front edge 24 is longer than the rear edge 25. It can readily be seen that the third indicator 17 is located in an area further from the front edge 24 than the second foot position 13; which is fixed.

While golf monitoring devices of various sizes will be suitable and the invention is not limited to a monitoring device of a particular size, it has been fund that for a device having a total length of 82 cm, the second indicator is located approximately 16 cm from the front edge 24, the foremost part 17*a* of the third indicator 17 begins approximately 20 cm from the front edge and the rearmost part 17*g* of the third indicator 17 lies approximately 31 cm from the front edge 24. Further, the foremost part 15*a* of the first foot indicator 15 lies approximately 50 cm from the front edge and the rearmost part 15*n* lies approximately 67 cm from the front edge.

The monitoring device assists the user by enabling him to readily determine when his body and both feet are squared to the straight edge 30. Also, the front foot 14 is positioned substantially at the same angle to the layer 10 for each shot with the same club. Also, when the club is moved rearwardly towards the rear edge 25 by causing the club head 20 to follow the take-away path of the curved edge 23, and swinging the club forward while causing the club to follow the curved edge 23 and striking the ball 18 while continuing to swing the club forward while still following the curved edge 23, can assist the golfer in developing an optimum golf swing for that golfer.

Preferably, the layer 10 is made of a rigid, but slightly flexible plastic with appropriate fold lines scored into the plastic so that the device can be folded into three sections for easy carriage in a golf bag. The indicators are preferably printed on the upper and lower surfaces but could be embossed. Alternatively, the layer 10 could be manufactured in the form of a rubber mat or other material. A rubber mat is not preferred even though it can be rolled up for storage into a convenient size as the mat will often not lie flat when it is unrolled. Also, parts of the mat can become twisted and the straight edge or the curved edge may be difficult to properly orient. For consistency, a user should line the same part of his feet with the indicators each time (for example, his big toe).

Numerous variations of the invention within the scope of the attached claims will occur to those skilled in the art.

What I claim as my invention is:

1. A golf swing monitoring device for use with a golf club and golf ball by a user having two feet, said device comprising an elongated layer having a front edge, a rear edge, a first straight side edge and a second curved, side edge corresponding to the two dimensional path of a proper golf swing, said device being small enough so that it can be located entirely between the user and the ball being addressed by the user, said device being oriented between the user and the ball with the first side edge being adjacent to the user and the second side edge being adjacent to the ball, with both the ball and the user located beyond the device, said first edge having a first rear foot indicator and a second front foot indicator thereon, said foot indicators being spaced apart from one another a distance corresponding to the distance between the user's feet in properly addressing a golf ball, said first indicator defining a plurality of placement locations of the rear foot of the user, said second foot indicator representing a placement of the front foot of the user, with a third indicator defining a plurality of placement locations of said ball at a point beyond said second side edge so that said ball forms an imaginary acute-angled triangle with said foot indicators.

2. A device as claimed in claim 1 wherein the first foot indicator is variable by the layer having a first set of location indicia thereon representing said first foot indicator and the third indicator is variable by the layer having a second set of location indicia thereon representing said third indicator.

3. A device as claimed in claim 1 wherein there is a target indicator, being parallel to the first side edge, located on each of the upper and lower surfaces.

4. A device as claimed in claim 1 wherein the device has an overall length of substantially 82 cm and a maximum width of substantially 14.3 cm.

5. A device as claimed in claim 1 wherein the front edge is longer than the rear edge.

6. A device as claimed in any one of claims 2 or 5 wherein the first indicator is variable within a lateral range of approximately 17 cm.

7. A device as claimed in claim 1 or 2 wherein the device has an upper and lower surface and the first, second and third indictors on an upper surface are a mirror image of the first, second and third indicators on a lower surface so that the device can be used by a user having a left-handed swing or a right-handed swing by flipping the device so that an appropriate surface is up.

8. A device as claimed in claim 1 wherein the device is one-piece and the layer is foldable.

9. A device as claimed in claim 8 wherein the layer can be folded into three sections and the folded device has a size of substantially 27.5 cm×15.5 cm×1 cm.

10. A device as claimed in of claim 1 or 2 wherein the third indicator is an area near said second foot indicator but on said second side edge.

11. A device as claimed in claim 1 or 2 wherein the third indicator is an area near said second foot indicator but on said second side edge and said third indicator is variable with a lateral range of approximately 11 cm.

* * * * *